US008550049B2

(12) United States Patent
Lohr

(10) Patent No.: US 8,550,049 B2
(45) Date of Patent: Oct. 8, 2013

(54) COVER WITH INTEGRATED BRACES

(75) Inventor: John Carl Lohr, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1139 days.

(21) Appl. No.: 12/492,723

(22) Filed: Jun. 26, 2009

(65) Prior Publication Data

US 2010/0326395 A1 Dec. 30, 2010

(51) Int. Cl.
*F02B 75/22* (2006.01)

(52) U.S. Cl.
USPC ..... 123/184.34; 123/184.61; 123/184.42; 123/184.47

(58) Field of Classification Search
USPC ..... 123/195 C, 198 E, 184.21–184.61; 181/204
See application file for complete search history.

(56) References Cited

U.S. PATENT DOCUMENTS 3,773,142 A 11/1973 Bragg et al.
5,323,740 A 6/1994 Dailey et al.
6,098,586 A 8/2000 Bloomer
6,199,530 B1 * 3/2001 Brassell et al. ..... 123/184.34
6,302,074 B1 10/2001 Bolsover et al.
6,598,581 B2 * 7/2003 Kempf ..... 123/198 E
6,745,739 B2 * 6/2004 Fujihira et al. ..... 123/184.21
7,059,289 B2 6/2006 Cunningham et al.
7,082,915 B2 * 8/2006 Tanikawa et al. ..... 123/184.42
7,204,218 B2 4/2007 vom Stein
2004/0194750 A1 10/2004 Tanikawa et al.

* cited by examiner

*Primary Examiner* — Hung Q Nguyen
(74) *Attorney, Agent, or Firm* — Julia Voutyras; Brooks Kushman P.C.

(57) ABSTRACT

A composite material intake manifold cover includes braces integral to the outside surface of the cover to stiffen the cover and reduce noise and vibration associated with the cover. The cover has a flange around the periphery with a raised weld bead, the weld bead provided for welding the cover to a mating piece. The flange extends outwardly from the cover for a first distance over most of the periphery and a second distance to support the braces over the remainder of the periphery. The braces extend upwardly from the upper surface of the flange at the sections of the flange extending out the second distance and may be placed between adjacent intake runner ports. By providing portions of the flange extending out a greater distance, a more substantial brace can be supported, thereby improving the noise and vibration characteristics relative to conventional stiffening ribs.

19 Claims, 5 Drawing Sheets

COVER WITH INTEGRATED BRACES

BACKGROUND

1. Technical Field

The present development relates to composite intake manifold assemblies, in particular to covers of such assemblies.

2. Background Art

It is known to manufacture intake manifold assemblies for internal combustion engines by injection molding a composite material. Because an intake system is subjected to pressure pulsations due to the induction of air into engine cylinders in an unsteady manner, the intake assembly can add to the noise emitted by the engine and/or lead to vibration of the engine assembly. Composite intake manifolds may include ribs to mitigate NVH (noise, vibration, and harshness) effects. However, one of the primary modes of an intake manifold plenum is a rocking motion, which is difficult to mitigate using only plenum shell ribs. Another approach to reduce noise and vibration is to provide one or more external brackets to enhance external stiffness. However, such brackets: are heavy, add to the part count, require assembly, interfere in underhood packaging, and are costly.

SUMMARY

According to an embodiment of the present invention, braces integral with the intake assembly, which extend from an external surface of the intake manifold assembly, are provided to stiffen the assembly. The intake manifold assembly is formed of several pieces which are joined together by vibration welding. The pieces have flanges at their peripheries and weld beads raised up from the flanges. The weld beads of the pieces that are to be coupled together are brought in contact with each other and then vibrated by a welder causing the weld beads to melt. The two pieces are joined upon cooling of the melted weld beads. Any of sonic, ultrasonic, laser, hot plate, and other welding methods known to one skilled in the art may be used to join the parts of the intake manifold assembly together.

According to an embodiment of the present disclosure, a cover and a mating piece are joined together. The cover includes a shell to enclose a cavity and a flange located at the periphery of the shell and extending outwardly from the shell. The two pieces (a cover and a mating piece) are joined at their respective flanges. The peripheral flanges have peripheral weld beads raised up on the surface of the peripheral flanges. Additionally, the two pieces have a plurality of brace flange portions extending outwardly from the peripheral flange a second distance, which is greater than the first distance. An integrally formed brace projects out of the cover in a generally upward direction. Because the brace flange portion extends outwardly beyond the peripheral flange, the brace flange portion provides support for a substantial brace to extend upwardly from the brace flange portion and the shell. Multiple braces can be provided at intervals around the periphery of the cover. Braces disposed between adjacent intake runner ports of the bell mouth housing may extend outward beyond the inboard opening of the intake runner ports to provide additional surface area and rigidity for bracing. Multiple braces are placed around the periphery of the cover spaced in a manner to reduce vibration and noise.

The brace, flanges, weld beads, and shell of the cover are integrally formed, thereby reducing part count over the prior art. By obviating the need for an external brace, no attachment points need be provided by the brace according to an embodiment of the present disclosure. The brace of the present disclosure is lighter, cheaper, and easier to assemble than the external braces of the prior art and provides additional support to reduce or eliminate the rocking mode that may otherwise be prevalent in assemblies that rely solely on ribs or similar structures to reduce NVH effects.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
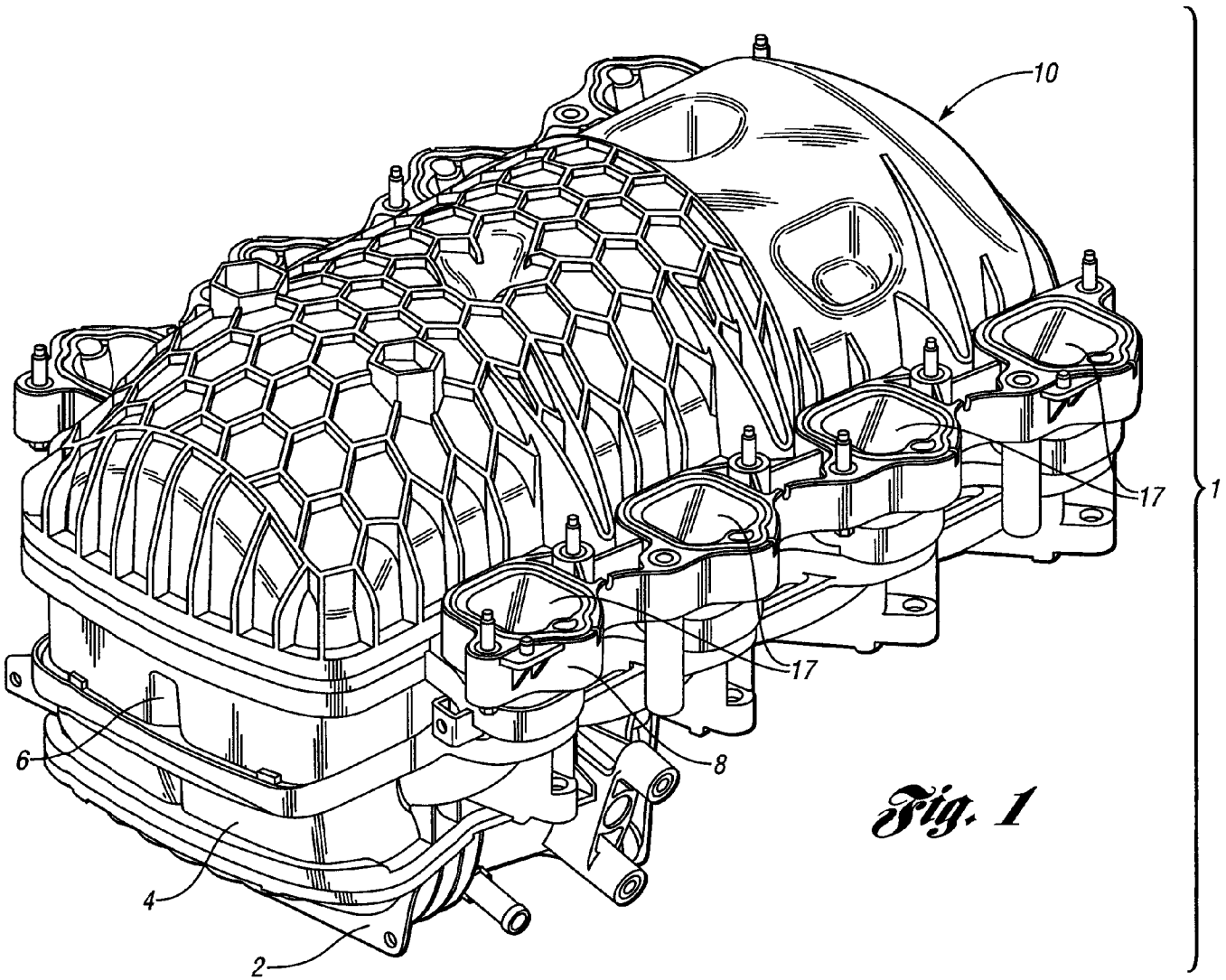
FIG. 1 is an isometric view of an intake manifold assembly.

An isometric view of an intake manifold assembly 1 in FIG. 1 shows a throttle body shell 2, a top shell 4, a middle shell 6, a bell mouth shell 8, and a cover 10. In this embodiment, cover 10, in cooperation with bell mouth shell 8, defines a plenum. The example shown in FIG. 1 is not intended to be limiting. Alternatively, a cover, similar to cover 10, can couple with fewer parts to form an assembly.

As used herein, directional words such as upward, downward, and the like refer the position of an intake manifold assembly as shown in the Figures. However, in a typical installation on a conventional V-type engine, the throttle body is arranged at the top and the cover 10 at the bottom. The Figures show cover 10 at the top and throttle body 2 at the bottom for purposes of highlighting features associated with cover 10. Those of ordinary skill in the art will understand that these words are used for convenience only and should be adjusted accordingly for orientations other than that shown in the Figures. The orientation described should not be interpreted as limiting.

Figure 2:
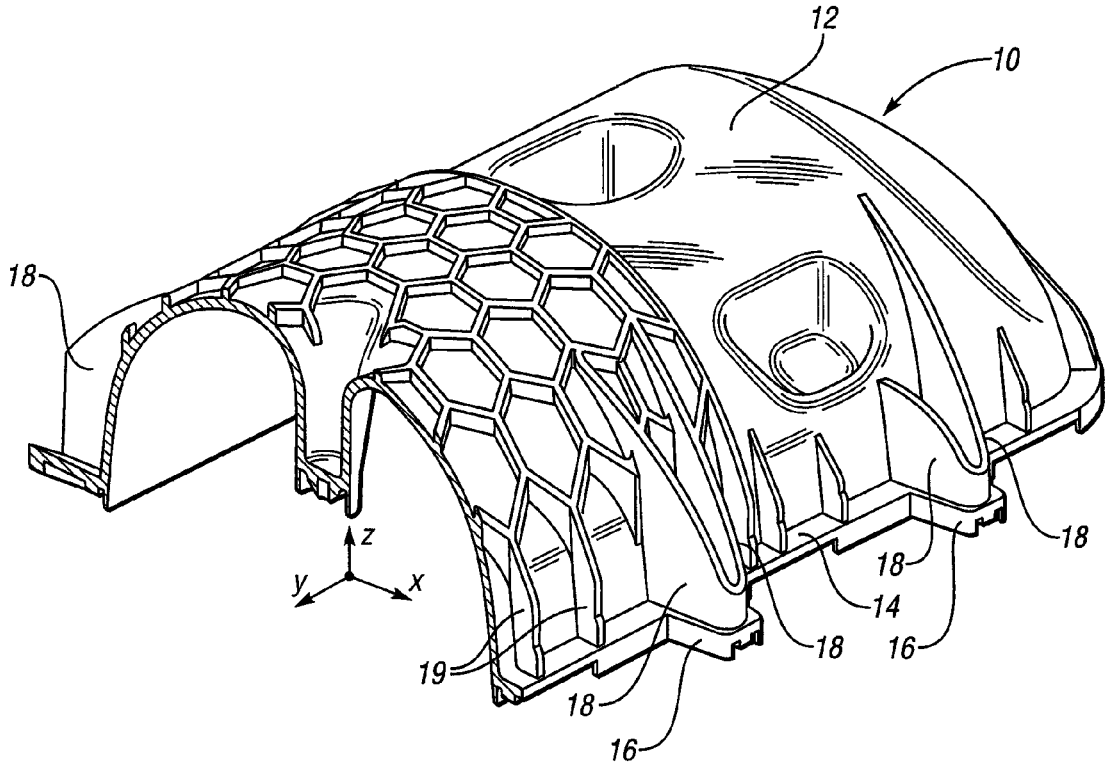
FIG. 2 is a partial isometric view of a cover according to an embodiment of the present disclosure.
Figure 6:
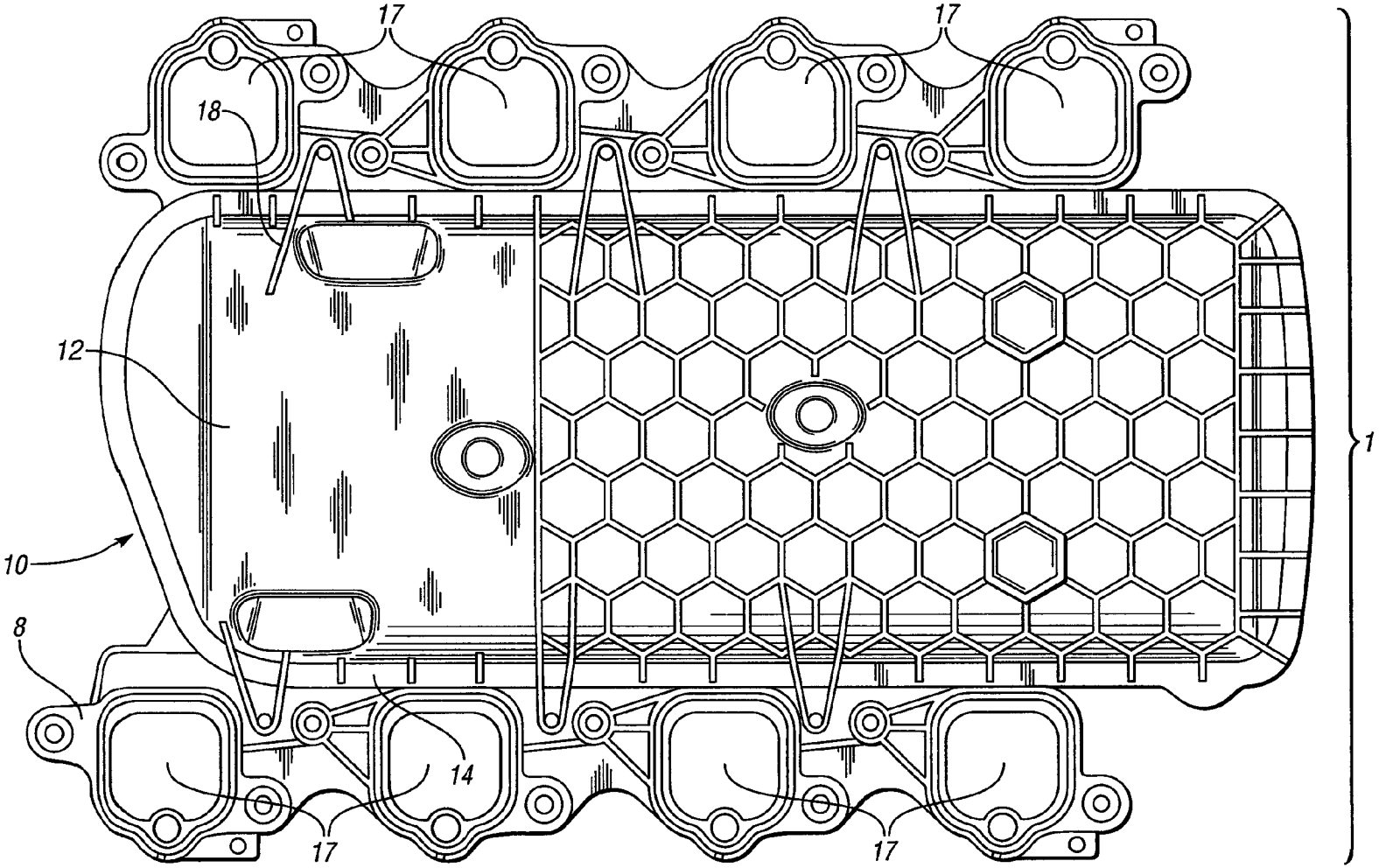
FIG. 6 is a topside view of the intake manifold assembly.

The cover 10, shown in FIG. 2, has a shell 12 with a peripheral flange 14 extending from a periphery of shell 12. Peripheral flange 14 extends around shell 12 to provide a surface for sealing coupling with a mating part of an assembly, such as bell mouth shell 8. A plurality of brace portions 16 extend generally outwardly from peripheral flange 14. Generally U-shaped braces 18 extend upwardly from brace flange portions 16 of peripheral flange 14, and are integrally formed in an outer surface of shell 12. Brace flange portions 16 provide a support for braces 18, which can extend outwardly from the outer surface of shell 12 as much as brace flange 16 extends from the periphery of shell 12. In FIGS. 1 and 6, brace flange portions 16 are shown disposed between adjacent intake runner ports 17 and extend generally outward beyond the inboard opening of the intake runner ports 17. The use of integral braces extending from the surface of shell 12 obviates the need for external bracing, thereby overcoming the complexity, part count, and weight problems of external braces while mitigating the rocking mode of some prior art composite intake assemblies. As shown in FIG. 2, braces 18 may include a pair of spaced side walls extending from shell 16 and joined by an arcuate section to form a generally U-shaped, V-shaped, or J-shaped brace depending on the particular position of the brace relative to other structures of the shell. However, braces 18 may be applied singly or in other combinations depending on the particular application and implementation. Cover 10 also has ribs 19. Ribs 19 cannot extend outwardly from shell 12 and flange 14 more than a small distance because they are supported by narrow portions of flange 14.

In covers that have ribs, such as ribs 19 in FIG. 2, but no braces, such as braces 18 in FIG. 2, the resulting noise and vibration during engine operation is unacceptable.

According to one application of external bracing in the prior art, two braces are installed on an intake manifold assembly to obtain an acceptable level of noise radiation and vibration from the assembly. In such application, each brace: weighs about 100 grams each, requires two threaded mounting locations to be supplied (one on the manifold assembly and one on an engine or other surface), and requires 2 bolts/washers to secure them, thereby adding five to the part count. For two such braces, part count is increased by 10 and weight by 200 grams. Braces according to an embodiment of the present disclosure: weigh about 50 grams total for six brace pairs, require no additional parts, require no mounting locations, and require no assembly, as they are molded in a unitary structure with the cover.

Figure 3:
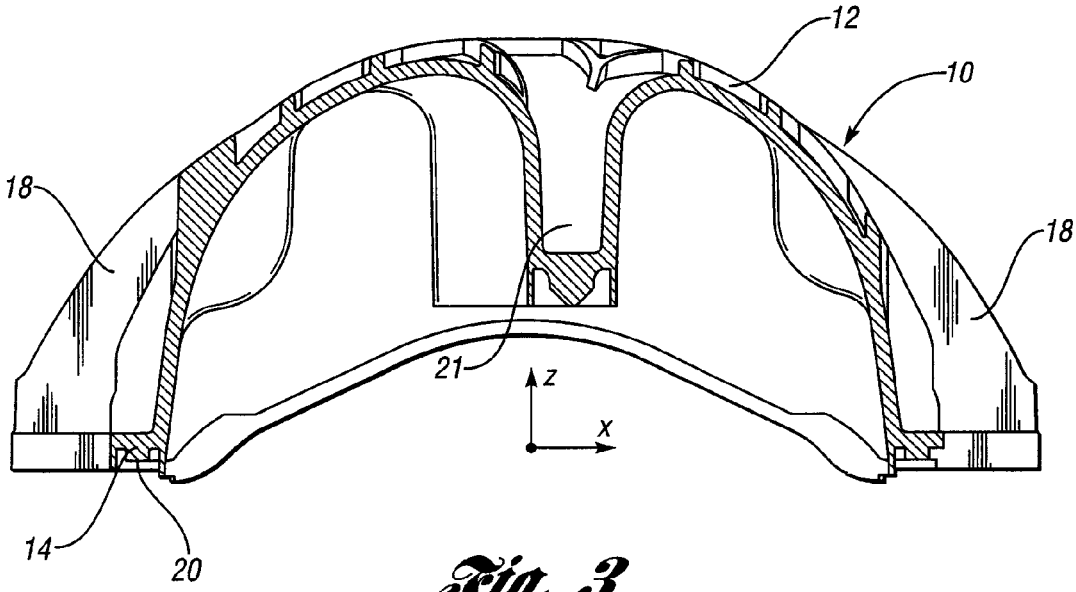
FIG. 3 is an end view of a cross-section of the cover according to an embodiment of the present disclosure.

Flange 14 lies in an X-Y plane at zero Z according to the X-Y-Z coordinate system shown in FIGS. 2-3 (Y comes out of the plane of FIG. 3). The non-peripheral portions of shell 12 extend in a positive Z direction. Shell 12, when coupled with a mating part, defines a cavity within to serve, for example, as a plenum. Extending in a negative Z direction from peripheral flange 14 is a peripheral weld bead 20 as also illustrated in the bottom view of FIG. 4. To assemble, weld bead 20 is placed next to weld beads provided on a mating part and then the mating parts are welded together. A post 21 extends downward (in a decreasing Z direction) from shell 12. Post 21 sits against another post (not shown) extending from a mating part to provide additional support for cover 10.

Figure 4:
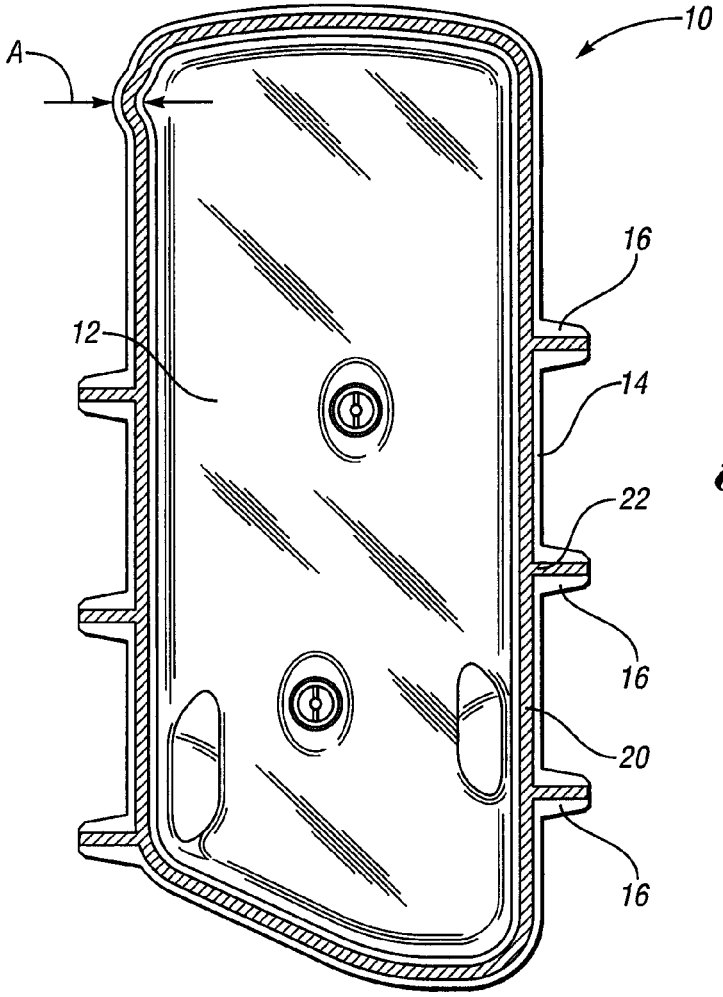
FIG. 4 is a underside view of the cover.

An underside view of cover 10 in FIG. 4 provides greater detail of the flanges and weld beads. Peripheral flange 14 is provided at the periphery of cover 10 with peripheral weld bead 20 providing a sealing surface. In FIG. 4, brace flange portion 16 is shown having a brace weld bead 22. Brace flange portion 16 lies generally in the same X-Y plane as peripheral flange 14 and brace weld bead 22 lies generally in the same plane as peripheral weld bead 20.

Figure 5:
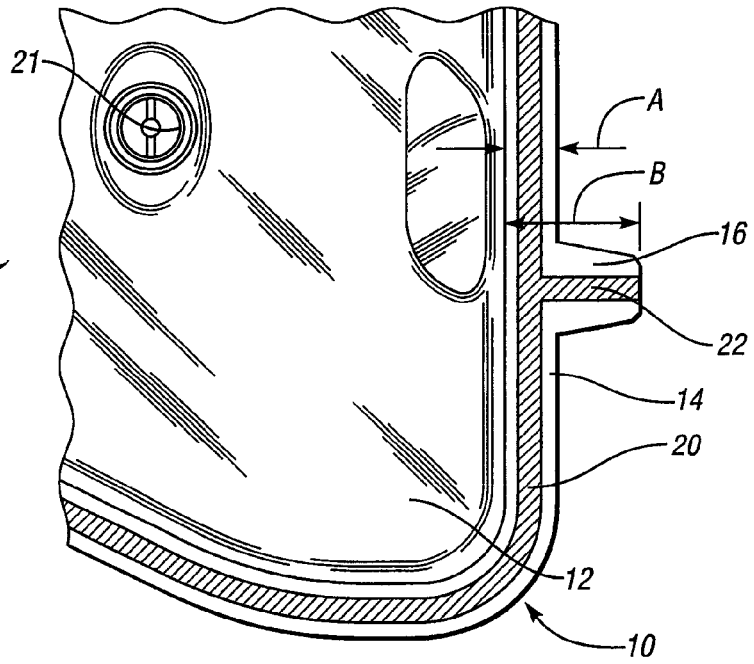
FIG. 5 is a partial underside view of the cover.

In FIG. 5, a portion of the cover is shown in which peripheral flange 14 extends from shell 12 outwardly a first distance, A. In brace flange portions 16, the extension from shell 12 is a second distance, B, which is at least 50% longer than A. By providing brace flange portions 16, braces 18 (not shown in this view) have a wider based on which to sit and thereby reduce noise and vibration more effectively, than without brace flange portions 16. In the embodiment illustrated in FIGS. 4 and 5, brace weld bead 22 and peripheral bead weld 20 are generally perpendicular and form a tee.

In the embodiment illustrated in FIGS. 1 and 6, intake manifold assembly 1 includes a plurality of braces 18 each positioned between two adjacent intake runner ports 17 so that each brace may extend beyond an inboard opening of its adjacent intake runner ports to provide desired rigidity and reduce or eliminate the rocking mode prevalent in some prior art composite intake manifold assemblies.

As such, the present disclosure provides a composite material intake manifold assembly having a cover or shell with an integrally formed flange, braces, and weld beads. By obviating the need for an external brace, no attachment points need be provided by the brace according to an embodiment of the present disclosure. The integral braces of the present disclosure are lighter, cheaper, and easier to assemble than the external braces of the prior art and provide additional support to reduce or eliminate the rocking mode that may otherwise be prevalent in assemblies that rely solely on ribs or similar structures to reduce NVH effects.

Figure 7:
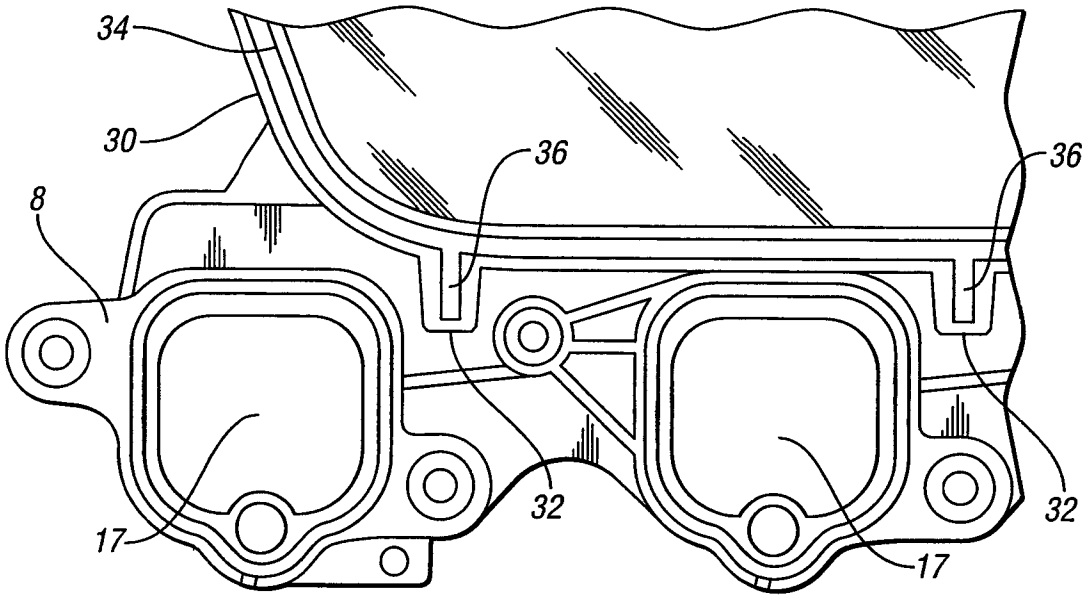
FIG. 7 is a portion of a bell mouth shell.

In FIG. 7, a portion of bell mouth housing 8 is shown having intake runner ports 17, a flange 30 having a brace flange portions 32, and weld beads 34 and 36. Weld beads 34 and 36 mate with weld beads 20 and 22, respectively, of cover 10 (FIGS. 4 and 5) when welded together.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

What is claimed:

1. A composite material intake manifold cover, comprising:

a shell having an inner surface and an outer surface;

a peripheral flange extending outwardly from a periphery of the shell, the peripheral flange lying in a first plane and extending outwardly a first distance from the periphery of the shell;

a peripheral weld bead extending generally downwardly from the peripheral flange, the peripheral weld bead lying in a second plane generally parallel to the first plane;

a brace flange portion extending outwardly from a portion of the peripheral flange of the shell a second distance, the second distance being greater than the first distance, the brace flange portion lying in the first plane;

a brace weld bead extending generally downwardly from the brace flange portion, the brace weld bead lying in the second plane; and a brace extending generally upwardly from the brace flange portion and integrally formed with the outer surface of the shell.

2. The cover of claim 1 wherein the brace includes first and second spaced arms extending upwardly and outward from the shell and joined by an arcuate portion.

3. The cover of claim 1 wherein the shell when coupled with an intake manifold assembly defines a cavity.

4. The cover of claim 1 wherein the peripheral weld bead and brace weld bead are integrally formed on a bottom side for welding to an intake manifold assembly.

5. The cover of claim 1, further comprising:

at least one post extending downwardly from the inner shell surface.

6. The cover of claim 1 further comprising: hexagonal ribs arranged in a honeycomb pattern on at least a portion of the outer surface of the shell.

7. The cover of claim 1 wherein the cover is coupled to a bell mouth housing having a plurality of intake runner ports and wherein each brace is disposed between adjacent intake runner ports.

8. The cover of claim 7 wherein the flange has a plurality of sides with a first long side across from a second long side and the cover has a plurality of braces with a first portion of braces located along the first long side and a second portion of braces located along the second long side.

9. The cover of claim 1 wherein the shell, the peripheral flange, the peripheral weld bead, the brace flange portion, the brace weld, and the brace are integrally formed of a unitary structure.

10. An intake manifold assembly, comprising:

a throttle body shell;

an upper shell welded to the throttle body shell;

a middle shell welded to the upper shell;

a bell mouth shell having a plurality of intake runner ports, the bell mouth shell welded to the middle shell; and a cover welded to the bell mouth shell, the cover and the bell mouth shell each having a peripheral flange extending outwardly a first distance and the cover and the bell mouth shell flanges each having brace flange portions extending outwardly from the peripheral flanges beyond an inboard side of adjacent intake runner ports, the brace flange portions and the peripheral flange of the cover having a weld bead extending downwardly toward the bell housing shell wherein the cover is welded to the bell housing shell along the weld bead.

11. The intake manifold assembly of claim 10 wherein the cover has an inner surface and an outer surface and the cover has a brace extending upwardly from the brace portion of the flange and being integrated into the outer surface of the cover.

12. The intake manifold assembly of claim 11 wherein each brace includes first and second spaced ribs joined by an arcuate section near an association brace flange portion.

13. A cover for an intake manifold assembly, comprising:

a shell;

a flange extending outwardly from a periphery of the shell wherein the flange extends outwardly from the periphery of the shell a first distance for a first portion of the periphery and extends outwardly from the periphery of the shell a second distance at each of a plurality of bracing locations disposed about the periphery; and a plurality of braces integrally formed with the shell and extending from an outer surface of the shell generally downward to an associated bracing location of the flange.

14. The cover of claim 13 further comprising an integrally formed weld bead disposed on a bottom surface of the flange.

15. The cover of claim 13 wherein the each of the plurality of braces comprises:

an arcuate portion joining first and second spaced risers extending upwardly from the bracing locations of the flange and blending flush into the shell.

16. The cover of claim 13 wherein each of the plurality of braces is disposed between adjacent intake runner ports of a bell mouth shell.

17. The cover of claim 13 wherein each of the brace flange portions extend outwardly from the shell at least twice as far as other portions of the flange.

18. The cover of claim 13 wherein the cover is adapted to be welded to a bell mouth shell having a plurality of intake runner ports and the brace flange portions extend outwardly from the shell at least beyond an inboard edge of the intake runner ports of the bell mouth shell.

19. The cover of claim 18 wherein the cover is welded to the bell mouth shell by one of: sonic welding, ultrasonic welding, laser welding, and hot plate welding.

* * * * *